United States Patent [19]

Taylor

[11] Patent Number: 4,571,776

[45] Date of Patent: Feb. 25, 1986

[54] RELEASABLE WINDOW HINGE

[75] Inventor: George A. Taylor, La Crescenta, Calif.

[73] Assignee: A. W. Anderberg Manufacturing Co., Los Angeles, Calif.

[21] Appl. No.: 601,384

[22] Filed: Apr. 17, 1984

[51] Int. Cl.[4] ..... E05D 11/08; E05D 15/00

[52] U.S. Cl. ..... 16/339; 16/363; 16/364; 16/369; 16/370; 16/371; 49/251

[58] Field of Search ..... 16/337, 338, 339, 340, 16/360, 361, 362, 363, 364, 368, 369, 370, 371, 374, 375, 376; 49/250, 251, 252, 260

[56] References Cited

U.S. PATENT DOCUMENTS 1,432,896 10/1922 Plym ..... 49/251
3,345,777 10/1967 Anderberg et al. ..... 49/250 X
4,364,201 12/1982 Taylor ..... 49/251 X

FOREIGN PATENT DOCUMENTS 2047309 11/1980 United Kingdom ..... 49/251

*Primary Examiner*—Fred Silverberg

*Attorney, Agent, or Firm*—Lyon & Lyon

[57] ABSTRACT

A window hinge assembly for use with windows which pivot outwardly of the room about a substantially vertical axis. Each hinge assemlby has a rail which mounts on one end of the window frame and a mounting bracket to connect to the window sash. Linkages between the mounting bracket and sliders on the rail allow the window to be opened to a position substantially perpendicular to its fully closed position and adjacent one vertical edge of the window opening to allow maximum opening for ventilation and as a possible emergency escape. A tool with at least one inclined surface is used to release a leaf spring connected to the support slider and positioned against a stop in the rail to allow inboard movement of the open window away from that adjacent edge of the window opening in order to facilitate cleaning of the exterior surface of the window. The support slider has one pivot pin joint for both a thrust linkage and brace. Clearance offsets are formed in the mounting bracket, the brace and the strut to accommodate this single pivot joint.

3 Claims, 5 Drawing Figures

RELEASABLE WINDOW HINGE

The field of the invention is window hinges and more particularly window hinges which allow angular movement of the window sash relative to the window frame about a vertical axis.

Windows which pivot about a vertical axis, also known as casement-type windows, are a great convenience to building designers and occupants. A small window which may be opened is desirable to provide air flow as well as providing a means of emergency escape, for example, in the event of a fire or such. Devices similar to the present invention are disclosed in U.S. Pat. Nos. 2,784,459 and 4,364,201. The major disadvantage of the supporting bracket of U.S. Pat. No. 2,784,459 is that due to the nature of the movement of the window sash upon opening said supporting bracket, inadequate room for escape is provided. On the other hand, while the support bracket of U.S. Pat. No. 4,364,201 provides a full opening for escape, it is impossible to clean the outside surface of the window from inside the room from which the window opens.

The present invention uses a rail which mounts to the window frame. The linkages are arranged so as to be slidably attached to the rail. The support slider has a pivotal connection wherein a link and a brace are connected about one pin on the slider. The link is connected to the window mounting bracket. A strut connects a friction slider to the brace and the window mounting bracket. A leaf spring and stop arrangement are used to maintain the position of the support slider during normal operation. This allows normal opening of the window to provide adequate space for air ventilation and a means of escape in times of emergency. A tool, with two inclined prongs for insertion beneath the leaf spring, is used to release the support slider when it is desired to clean the outside of the window. By releasing the leaf spring, the entire window assembly may be moved inboard to provide adequate room between the outside of the window and the side of the window opening to allow the window to be cleaned from inside the room.

It is an object of the invention to provide a releasable window hinge in which the window rotates about a substantially vertical axis in order to supply ventilation.

It is an additional object of the invention to provide such a window hinge which allows maximum window opening so as to possibly accommodate a means of escape in case of an emergency.

A further object of the invention is to provide such a window hinge which allows the exterior surface of the window to be cleaned from inside the room from which the window is opened. Other and more detailed objects of the invention will become apparent upon examination of the detailed description and drawings herein, wherein.

Figure 1:
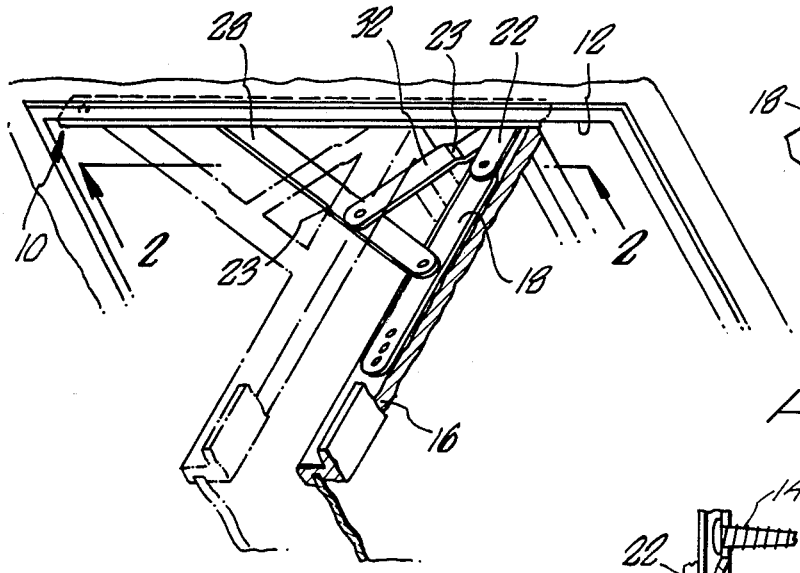
FIG. 1 is a perspective view showing the releasable window hinge in its normal open position with the window in its released position shown in phantom and certain portions broken away for clarity of illustration.
Figure 2:
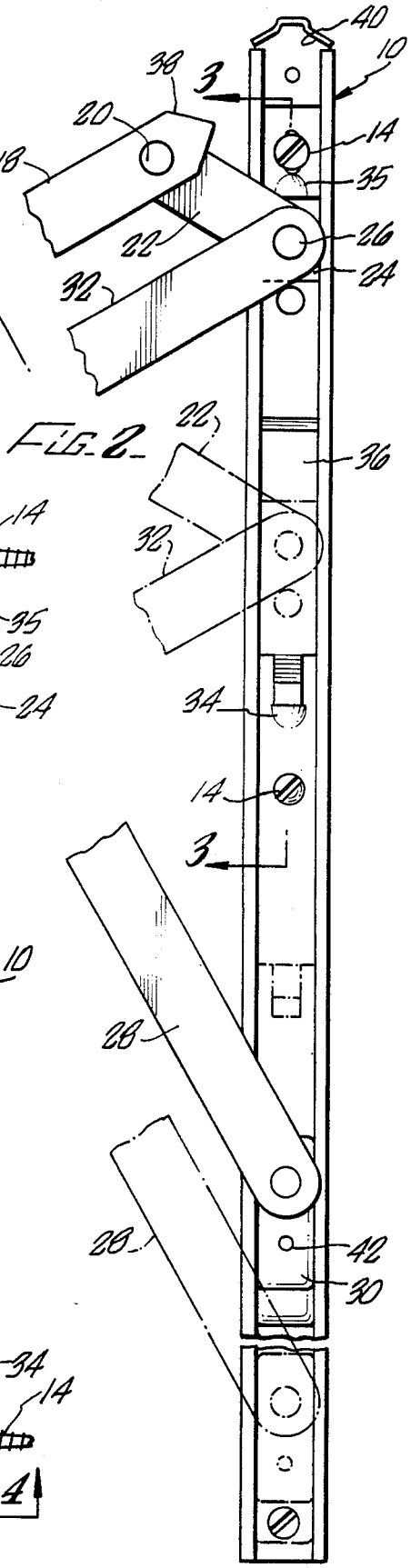
FIG. 2 is a view substantially along line 2—2 of FIG. 1 showing the window hinge in its normal operating position and the released position shown in phantom.
Figure 3:
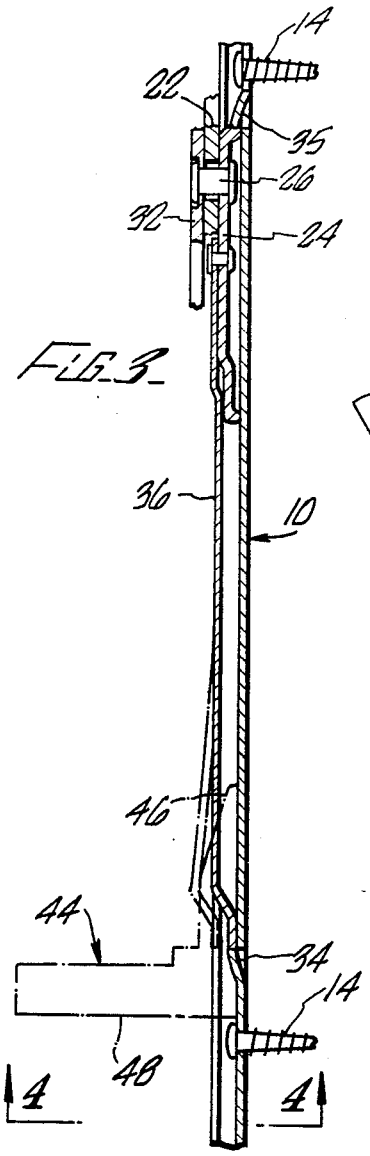
FIG. 3 is a cross-sectional view taken substantially along line 3—3 of FIG. 2 with the releasing tool and the disengaged leaf spring shown in phantom.
Figure 4:
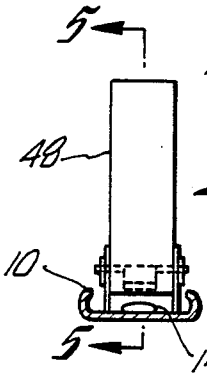
FIG. 4 is a cross-sectional view taken substantially along line 4—4 of FIG. 3 showing the positioning of the window hinge releasing tool.
Figure 5:
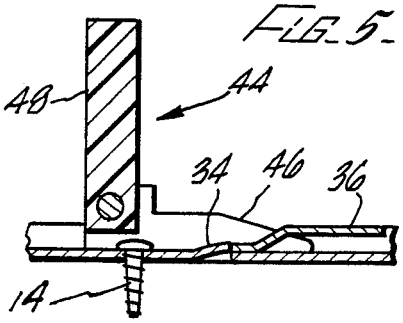
FIG. 5 is a cross-sectional view taken substantially along line 5—5 of FIG. 4 showing the window hinge releasing tool being inserted to release the hinge leaf spring mechanism.

As shown in the figures, the preferred embodiment of the invention consists of a series of linkages slidably attached to a rail 10 which is mounted to the inside of the window frame 12 by screws 14. It is anticipated that the releasable window hinge will be used in pairs and thus, the window sash 16 will have a window mounting bracket 18 at its top and bottom. The window hinges can be mounted for opening the window to the left or right and therefore throughout this application the term "outboard" will be used to identify the direction and the vertical side of the window frame opening (i.e., to the right in FIG. 1) about which the window sash pivots and is located in the normal open position, with the term "inboard" meaning the opposite direction and window frame opening vertical edge (i.e., to the left in FIG. 1). A support slider 24 is used at the outboard end of the rail 10 near one vertical edge of the window frame opening to carry the weight of the window. A friction slider 30 is mounted at the other or inboard end of the rail 10 to provide adjustable frictional resistance to the opening and closing of the window.

The outboard end of the window mounting bracket 18 is pivotally connected by a pivot pin 20 to a thrust link 22. The other end of the thrust link 22 is pivotally connected by a second pivot pin 26 to the support slider 24. A strut 28 is pivotally connected to about the midpoint of the window mounting bracket 18. The other end of the strut 28 is pivotally connected to the friction slider 30 which is arranged so as to be retained in and moveable along the rail 10.

A brace 32 is connected between an intermediate point on the strut 28 and the support slider 24. The brace 32 is pivotally mounted to the support slider 24 on the same pivot pin joint 26 as the thrust link 22. Clearance offsets 23 are provided in the mounting bracket 18, the strut 28 and the brace 32 to accommodate the single support slider 24 pivot pin joint 26.

The pivot pin 26 is preferrably a solid rivet that is swedged onto the brace 32 in a countersunk position so as to be clear of the mounting bracket 18 and having journal portions for rotatably supporting the thrust link 22. The pivot pin 26 is rotatable relative to the support slider 24 and has a swedged end between the support slider 24 and the rail 10 to maintain the elements in the preferred assembled relationship.

A first stop 34 is formed in the rail 10 just outboard of the midpoint of the rail 10. A leaf spring 36 is connected to the support slider 24 and is of sufficient length so as to engage with the stop 34 when the window hinge is in its normal outboard operating position. A second stop 35 is formed in the rail 10 and positioned outboard of the support slider to fix the position of the support slider 24.

A triangular rider 38 is formed at the outboard end of the window mounting bracket 18. A cam surface 40 is attached to the corresponding end of the rail 10 and has a shape substantially that of an inverted V.

A set screw 42 is provided in the friction slider 30 in order to adjust the force required to operate the hinge mechanism.

The operation of the invention is as follows. A pair of hinge mechanisms are mounted on opposite ends of the window frame and the window is secured on each side to the window mounting bracket 18. The rails 10 are positioned against the window frame 12 so that the cam surface 40 is at the outboard side thereof. Upon releasing any not-shown window latches, an outward force applied to the inboard edge of the window will cause the triangular rider 38 to direct motion in an outward direction. The thrust link 22 will begin to pivot about the pivot joint 26 on the support slider 24 to move the window clear of the frame while the friction slider 30 begins to move outboard on the rail 10. Further force will create a outward and opening motion such that the window will pivot substantially about a vertical axis until the window is substantially perpendicular to its fully closed position.

This mode of operation allows maximum opening of the window to provide ventilation as well as providing a possible means of escape in case of an emergency. In order to clean the exterior surface of the window from inside the room, the release mechanism is operated. The release mechanism includes a tool 44 with a handle 48 and two inclined prongs 46. The tool 44 is inserted onto the rail 10 such that the tips of the inclined prongs 46 are beneath the edges of the end of a leaf spring 36, which has a central portion bent toward the rail 10 and its end in contact with the first stop 34. Further motion of the tool 44 towards the support slider 24 will raise the leaf spring 36 above the first stop 34 and enable the support slider 24 and the friction slider 30 to move inboard to a position where the support slider 24 is in contact with the first stop 34 or the friction slider 30 engages another convenient stop, not shown. By so doing, an additional space is created between the outboard side of the window frame and the exterior of the window so as to facilitate the cleaning of the outside of the window. When it is desired to return the window to its normal operating position, an outboard force applied to the window sash 16 will move the window outboard so that the leaf spring 36 reengages with the first stop 34.

Having fully described the invention, it is to be understood that the description contained herein is merely to be used for illustration and no limitations beyond those set forth in the appended claims should be construed therefrom.

We claim:

1. A releasable window hinge, comprising, a rail with a stop formed near one end, a first slider moveable along said rail and retained near said one end of said rail by said stop in said rail, a thrust link, a brace, means pivotally connecting one end of said thrust link and one end of said brace to said slider, a window mounting bracket pivotally connected to the other end of said thrust link, a second slider moveable along said rail, a strut pivotally connected to said second slider, means pivotally connecting the other end of said brace to said strut, means pivotally connecting the other end of said strut to said mounting bracket, and releasable means to maintain the normal position of said first slider at said one end of said rail and when said releasable means are released to allow movement of both said sliders, said thrust link, said brace and said window mounting bracket relative to said rail without pivoting.

2. A releasable window hinge as set forth in claim 1 wherein a coacting cam is provided between one end of said mounting bracket and one end of said rail.

3. A releasable window hinge as set forth in claim 2 wherein said second slider is provided with means to adjust the force required to operate said hinge.

* * * * *